US009850643B2

(12) United States Patent
Eilmus et al.

(10) Patent No.: US 9,850,643 B2
(45) Date of Patent: Dec. 26, 2017

(54) SINK WITH DRAIN COVER

(71) Applicant: Kohler Co., Kohler, WI (US)

(72) Inventors: Niels J. Eilmus, Sheboygan, WI (US); Jason R. Miller, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 14/207,309

(22) Filed: Mar. 12, 2014

(65) Prior Publication Data

US 2014/0259380 A1 Sep. 18, 2014

Related U.S. Application Data

(60) Provisional application No. 61/781,769, filed on Mar. 14, 2013.

(51) Int. Cl.
*A47K 1/04* (2006.01)
*E03C 1/22* (2006.01)

(52) U.S. Cl.
CPC ..... *E03C 1/22* (2013.01)

(58) Field of Classification Search
USPC ..... 4/650, 293, 655
See application file for complete search history.

(56) References Cited

U.S. PATENT DOCUMENTS 1,908,128 A * 5/1933 De Bie ..... A47L 19/04 211/41.3
4,253,402 A * 3/1981 Carrig ..... A47B 87/0261 108/27
4,807,306 A 2/1989 Haymen et al.
5,509,150 A † 4/1996 Bergmann
6,219,861 B1 4/2001 Chen
(Continued)

FOREIGN PATENT DOCUMENTS

CN 101568284 10/2009
CN 101748780 6/2010
(Continued)

OTHER PUBLICATIONS

Notification of First Office Action dated Mar. 16, 2015 regarding Chinese Application No. 201410093133.8, 10 pages.
(Continued)

*Primary Examiner* — Lauren Crane
(74) *Attorney, Agent, or Firm* — Foley & Lardner LLP

(57) ABSTRACT

One embodiment of the application relates to a sink assembly including a sink and a drain cover. The sink includes a basin and a projection provided in a bottom wall of the basin. The projection includes a first portion and a second portion that define a cavity and a drain opening. The first portion extends from the bottom wall at a first orientation and the second portion extends from the first portion at a second orientation that is different than the first orientation. The drain cover is installed into the cavity of the projection. The drain cover includes a base and at least one leg extending downward from a bottom surface of the base. The base has a top surface that is substantially coplanar with an upper surface of the bottom wall, and has an outer periphery that extends beyond an outer periphery of the drain opening.

12 Claims, 11 Drawing Sheets

(56) References Cited

U.S. PATENT DOCUMENTS

| | | | | |
|---|---|---|---|---|
| 6,367,102 | B1 | 4/2002 | McMullen | |
| 7,000,266 | B2 * | 2/2006 | Piatt | A47K 1/04 4/619 |
| 7,665,160 | B1 | 2/2010 | Linder | |
| 7,900,288 | B2 | 3/2011 | Fima | |
| 2008/0148474 | A1 * | 6/2008 | Witt | 4/613 |
| 2009/0049601 | A1 | 2/2009 | Shih | |
| 2012/0036697 | A1 * | 2/2012 | Cook | 29/428 |
| 2013/0061387 | A1 * | 3/2013 | Stetson | E03F 5/0408 4/613 |

FOREIGN PATENT DOCUMENTS

| | | |
|---|---|---|
| CN | 201730161 | 2/2011 |
| DE | 20103271 | 6/2001 |
| EP | 1580337 | 9/2005 |
| GB | 2426446 | 11/2006 |
| JP | H11100880 | 4/1999 |
| JP | 2000008472 | 1/2000 |
| JP | 2000265513 | 9/2000 |
| JP | 2010053673 | 3/2010 |
| JP | 2011214339 | 10/2011 |

OTHER PUBLICATIONS

United Kingdom Search Report regarding Application No. 1040637.9 (4 pgs).

* cited by examiner
† cited by third party

SINK WITH DRAIN COVER

CROSS-REFERENCE TO RELATED PATENT APPLICATIONS

This application claims the benefit of and priority to U.S. Provisional Patent Application No. 61/781,769, which was filed on Mar. 14, 2013. The foregoing U.S. provisional application is incorporated by reference herein in its entirety.

BACKGROUND

This application relates generally to the field of sinks. More specifically, this application relates to sinks having drain covers that are configured to have a seamless appearance while allowing for sufficient draining.

SUMMARY

One embodiment of the application relates to a sink assembly including a sink and a drain cover. The sink includes a basin and a projection provided in a bottom wall of the basin. The projection includes a first portion and a second portion that define a cavity and a drain opening. The first portion extends from the bottom wall at a first orientation and the second portion extends from the first portion at a second orientation that is different than the first orientation. The drain cover is installed into the cavity of the projection. The drain cover includes a base and at least one leg extending downward from a bottom surface of the base. The base of the drain cover has a top surface that is substantially coplanar with an upper surface of the bottom wall of the basin, and has an outer periphery that extends beyond an outer periphery of the drain opening.

Another embodiment of the application relates to a sink. The sink includes a basin having a bottom wall, a projection provided in the bottom wall, and a drain removably coupled to the basin. The drain includes a flange and a body extending therefrom. The projection includes a first portion and a second portion that define a cavity and a drain opening. The first portion extends from the bottom wall at a first angle, and the second portion extends from the first portion at a second angle that is different than the first angle.

Yet another embodiment of the application relates to a drain cover for a drain opening in a sink. The drain cover includes a base having a top and bottom, and at least one leg extending away from the bottom. When the drain cover is installed into the sink, the top of the base is substantially coplanar with a bottom wall of the sink, and an outer periphery of the base extends beyond an outer periphery of the drain opening.

DETAILED DESCRIPTION

Referring generally to the Figures, disclosed herein are sink assemblies configured having drains that are configured to be covered with drain covers that provide a seamless appearance with the sinks, while allowing for sufficient draining through the drain.

FIGS. 1-6 illustrate a sink assembly 100 having a sink 110 with a drain opening 114 covered by a drain cover 120, according to an exemplary embodiment. The sink 110 may have any suitable shape that is configured as a vessel (e.g., a container) that is able to hold a volume of water therein. The sink 110 may be generally polyhedron (e.g., hexahedron) shaped with an open side therein. For example, the sink 110 may be generally hexahedron shaped with an open top surface. The sink 110 may be made of metal, such as a stainless steel or a cast iron, or any other suitable material. Further, the sink 110 may have a coating, such as chrome or enamel, which may be provided over at least the visible surfaces (e.g., when installed) to change the exterior appearance of the sink 110.

Figure 1:
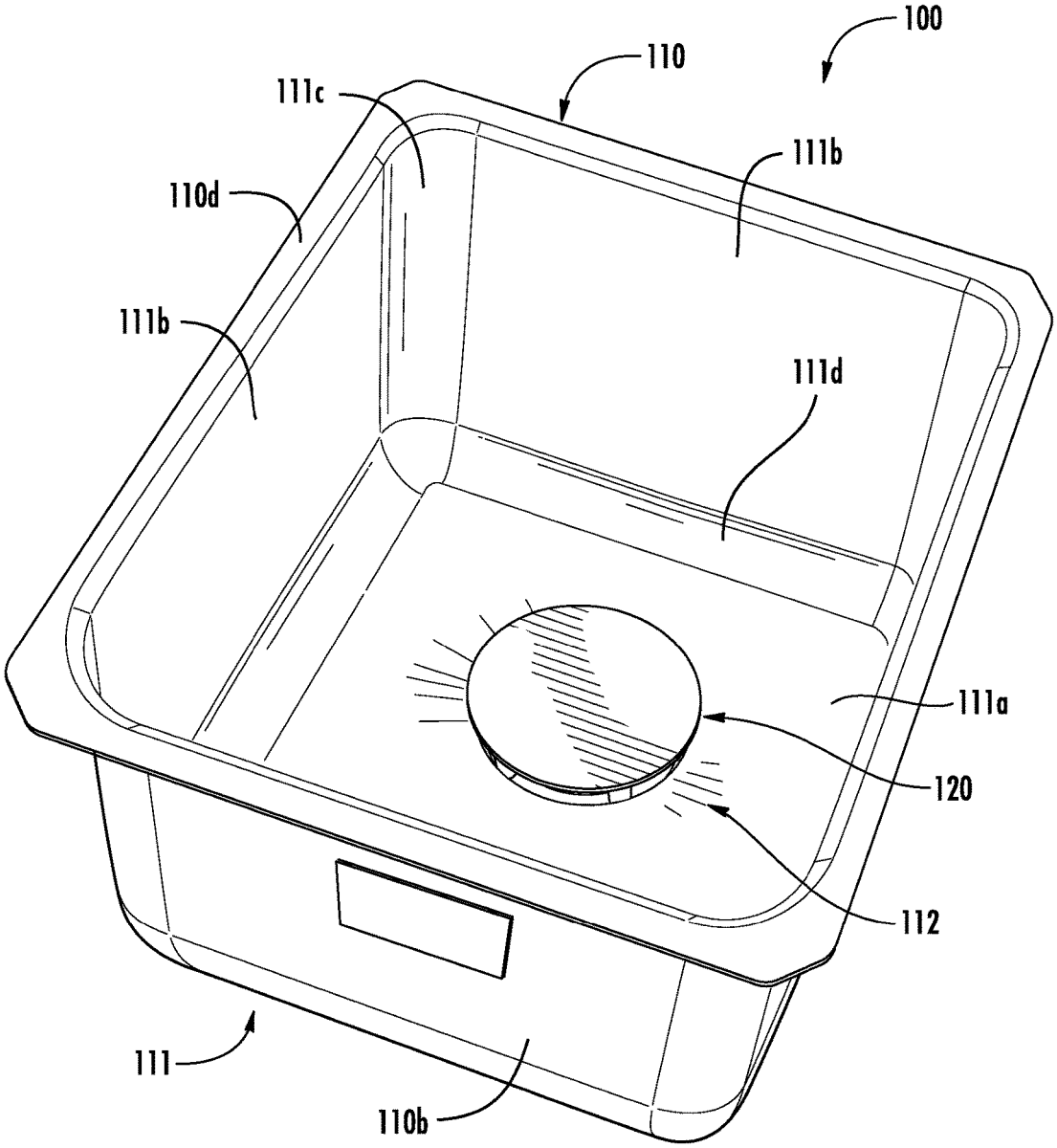
FIG. 1 is a perspective view of a sink having a drain opening covered by a drain cover, according to an exemplary embodiment.
Figure 1A:
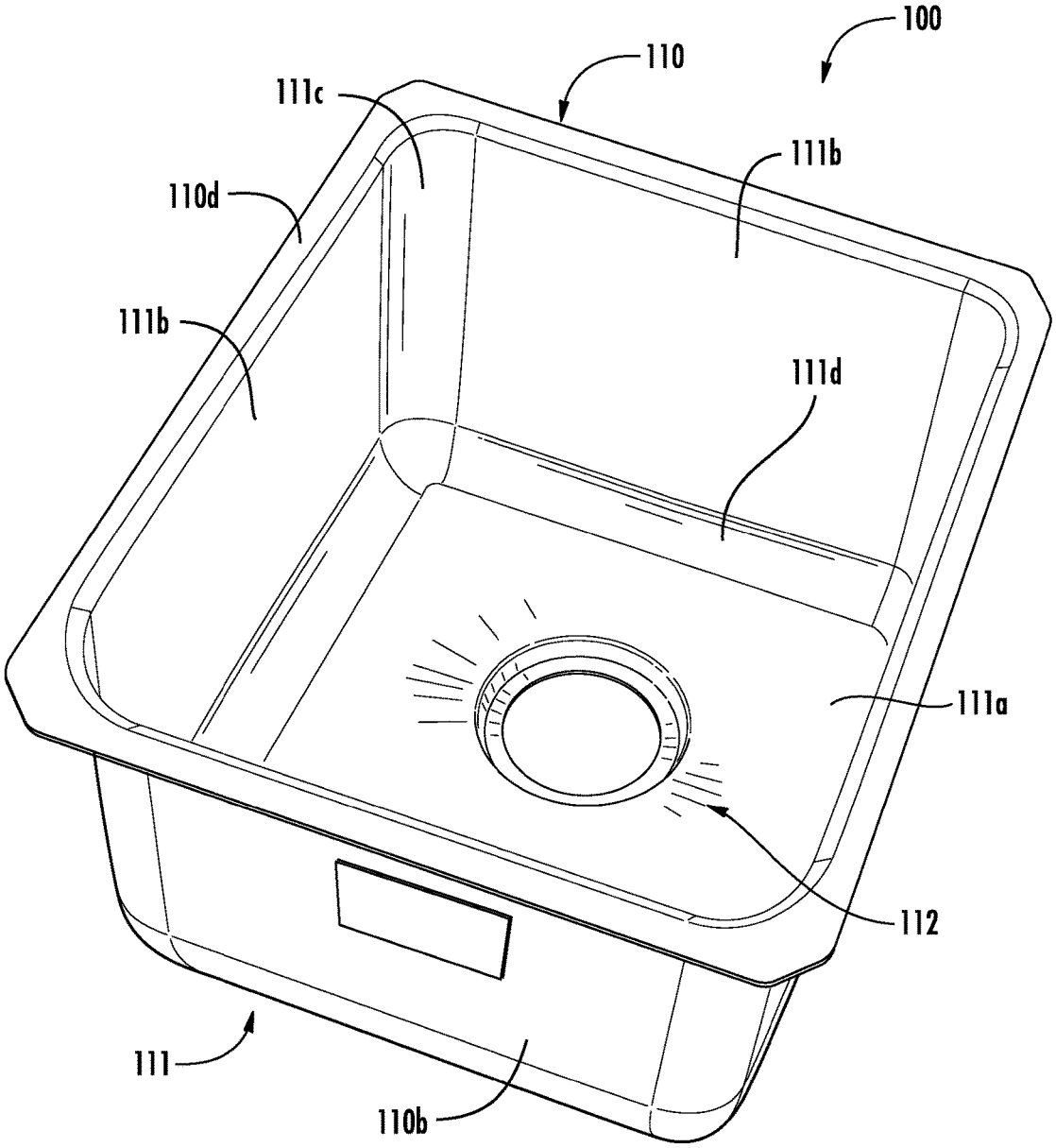
FIG. 1A is a perspective view of the sink of FIG. 1 without a drain cover installed.
Figure 2:
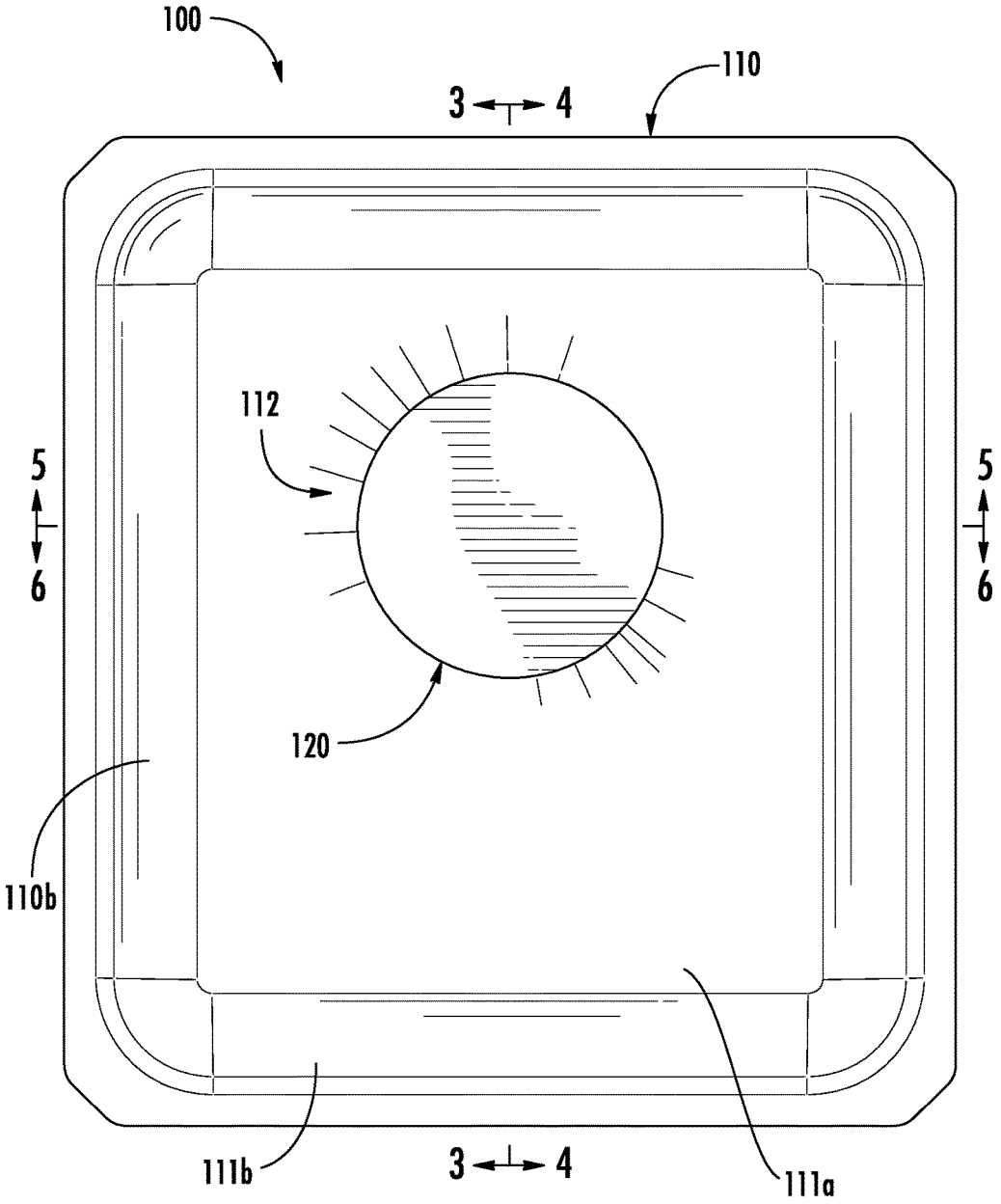
FIG. 2 is a top view of the sink and drain cover of FIG. 1.
Figure 2A:
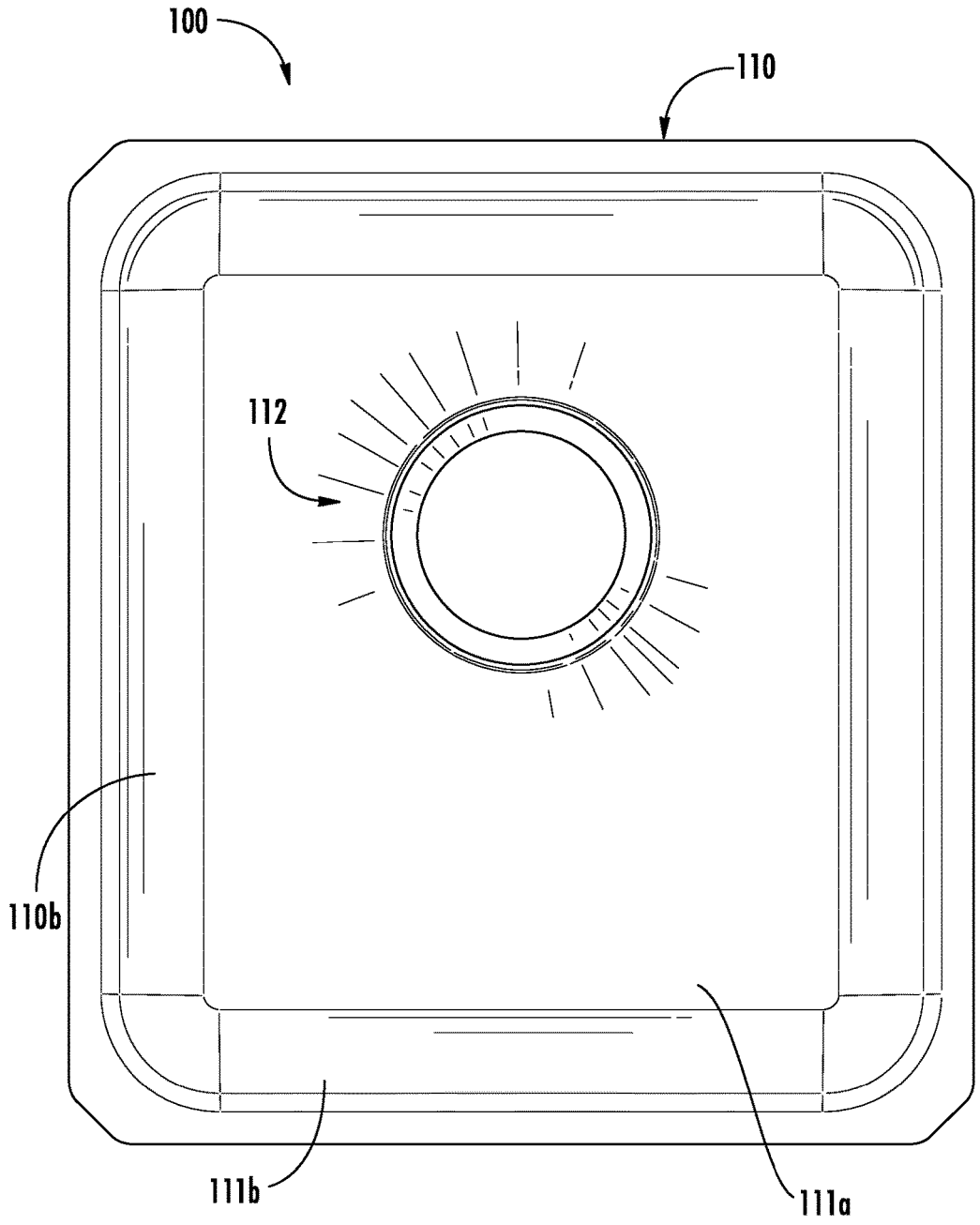
FIG. 2A is a top view of the sink of FIG. 1 without a drain cover installed.

As shown in FIGS. 1-2A, the sink 110 includes a basin 111 and a projection 112 (e.g., a recessed portion or component, an insert, an integrally molded member, a depression, an indentation, etc.). The basin may include a wall or a plurality of walls. As shown, the basin includes a bottom wall 111*a* (e.g., floor, base, etc.) and four side walls 111*b* extending upwardly from the bottom wall 111*a*, where the four side walls 111*b* include two pair of opposing side walls. The bottom wall 111*a* may be generally flat or may be curved (e.g., crowned). Each side wall 111*b* may extend from the bottom wall 111*a* in a perpendicular direction or may extend at an angle relative to the bottom wall. Each pair of adjacent side walls 111*b* may be connected by a transition

111*c* (e.g., upper transition), which may be a curved portion. Additionally, each side wall may be connected to the bottom wall with a transition 111*d* (e.g., lower transition). The upper and lower transitions 111*c*, 111*d* may have overlapping areas, such as in the corners between two adjacent side walls 111*b* and the bottom wall 111*a*.

The projection 112 may be configured to extend from the basin 111. As shown in FIGS. 3-6, the projection 112 is provided in the bottom wall 111*a* of the basin 111. The projection 112 may extend away (e.g., downwardly) from the bottom wall 111*a*, such as a bottom surface of the bottom wall. In other words, the projection 112 is configured as a recess, such as when viewed from above the sink 110. As shown, the projection 112 is integrally formed with the basin 111. In other words, the projection 112 may be configured as an extension of the sink 110. Alternatively, the projection 112 may be formed separately from the basin 111 and operatively coupled thereto to form a container capable of holding water therein, such as when the drain is closed.

Figure 3:
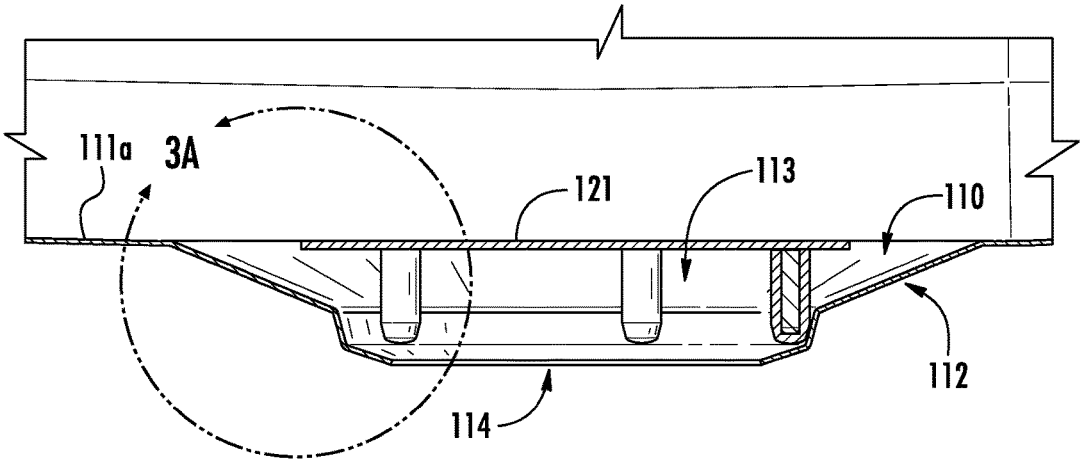
FIG. 3 is a partial cross-sectional view of the sink and drain cover of FIG. 2 taken along line 3-3.

As shown in FIG. 3, the projection 112 defines a cavity 113 and a drain opening 114. For example, in some embodiments, the projection 112 extends generally downwardly from the bottom wall 111*a* and forms a cavity 113 between the projection and a first plane P1 that is coplanar with the bottom wall 111*a* of the basin. The projection 112 may include an opening in the form of a drain opening 114, where the drain opening 114 is configured to receive a drain (see, for example, drain 740 of FIG. 7 or drain 840 of FIG. 8), if provided in the assembly 100, and drain water (and objects washed down by the water) from the sink 110.

The projection 112 may include one or more than one portion extending in a recessed fashion relative to the bottom wall 111*a* to form a recessed projection. In other words, the recessed projection 112 may include more than one recess (e.g., portion that is recessed below the sink). According to an exemplary embodiment, the projection 112 includes a first portion 112*a* and a second portion 112*b*, which may define the cavity 113 and/or the drain opening 114. The first portion 112*a* may be configured to extend from or relative to the bottom wall 111*a* at a first orientation, and the second portion 112*b* may be configured to extend from or relative to the first portion 112*a* at a second orientation, which may be configured to be different than the first orientation.

Figure 3A:
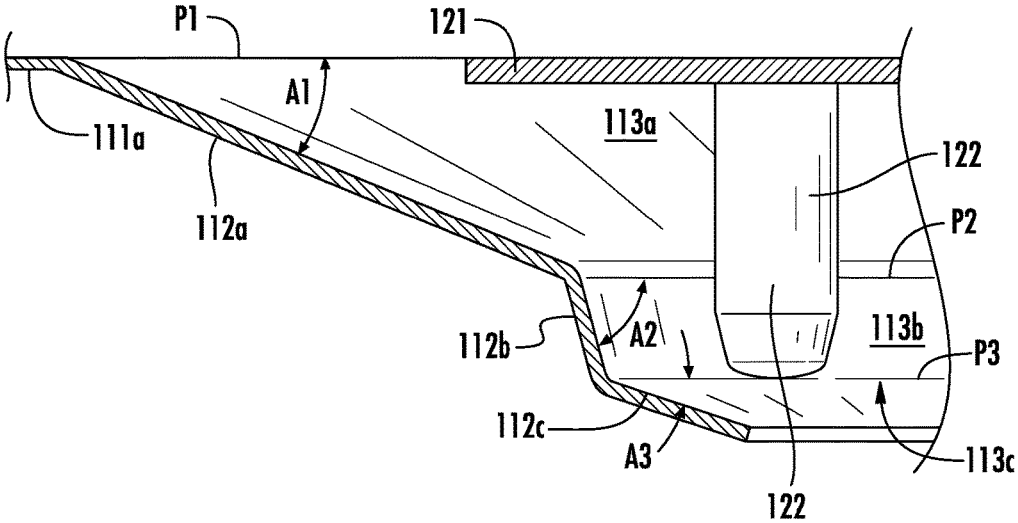
FIG. 3A is a detail view of a portion of the cross-sectional view of FIG. 3.
Figure 4:
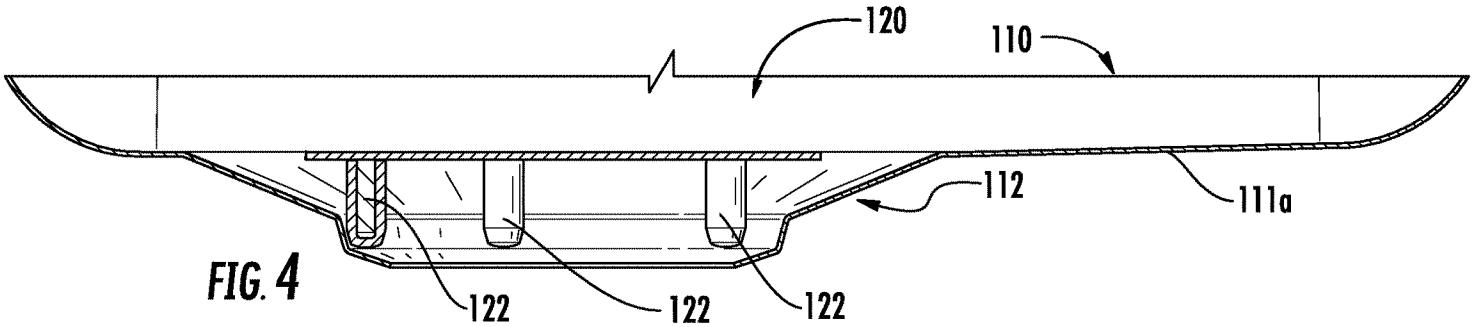
FIG. 4 is a partial cross-sectional view of the sink and drain cover of FIG. 2 taken along line 4-4.
Figure 5:
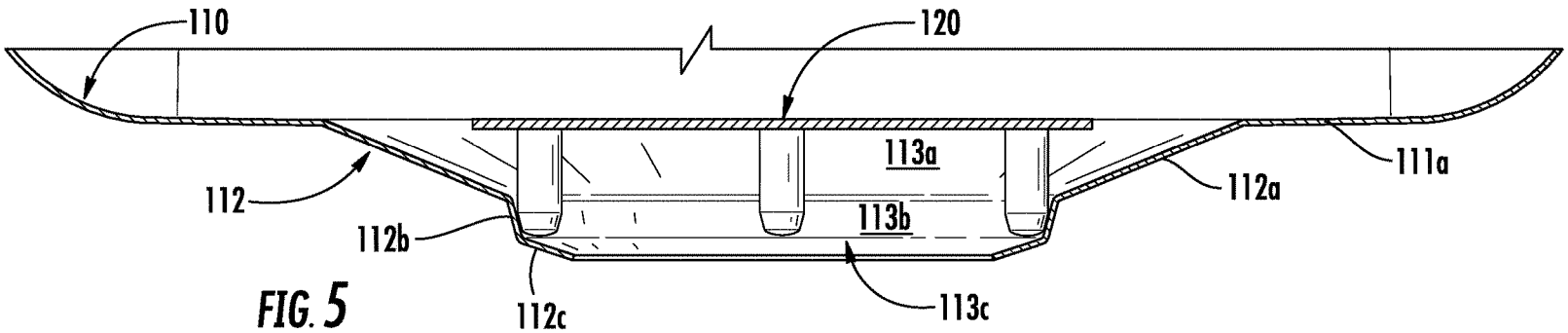
FIG. 5 is a partial cross-sectional view of the sink and drain cover of FIG. 2 taken along line 5-5.
Figure 6:
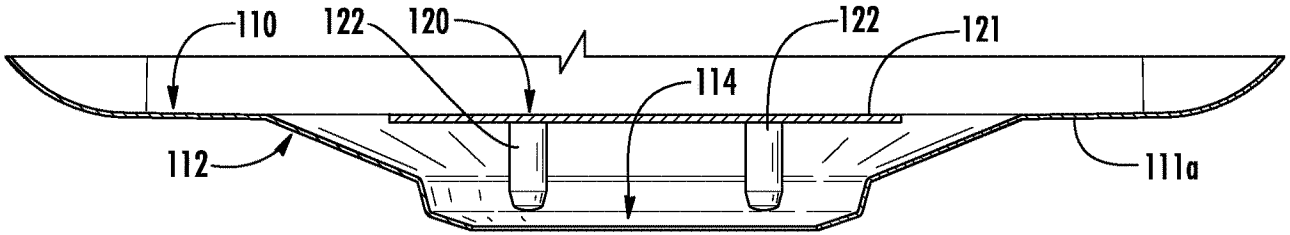
FIG. 6 is a partial cross-sectional view of the sink and drain cover of FIG. 2 taken along line 6-6.

As shown in FIGS. 3 and 3A, the projection 112 includes a first portion 112*a*, a second portion 112*b*, and a third portion 112*c*. The first portion 112*a* is frusto-conical shaped and extends from the bottom wall 111*a* of the basin 111 at a first orientation in the form of a first angle A1 relative to the first plane P1 of the bottom wall. The second portion 112*b* is frusto-conical shaped and extends from the first portion 112*a* of the projection 112 at a second orientation in the form of a second angle A2 relative to a second plane P2 of the bottom wall 111*a*. The third portion 112*c* is frusto-conical shaped and extends from the second portion 112*b* of the projection 112 at a third orientation in the form of a third angle A3 relative to a third plane P3 of the bottom wall 111*a*. As shown, the third portion 112*c* may include an opening that serves as the drain opening 114.

Figure 9:
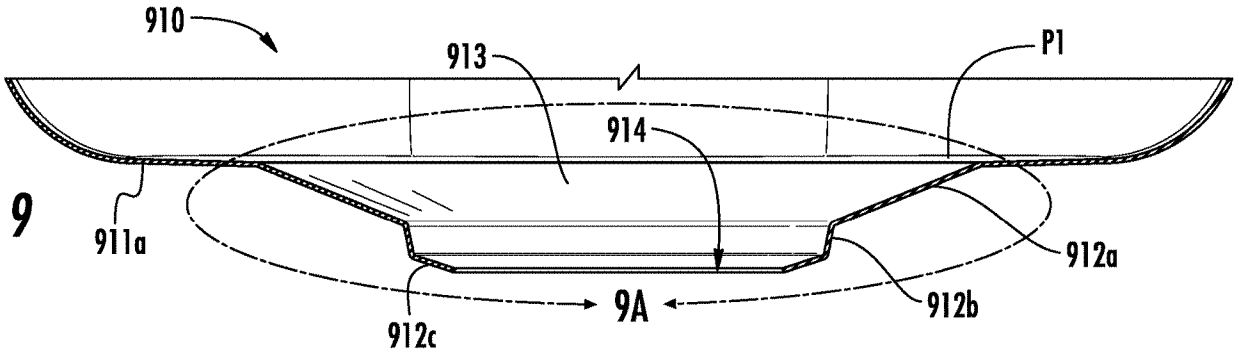
FIG. 9 is a cross-sectional view of a sink, according to an exemplary embodiment.
Figure 9A:
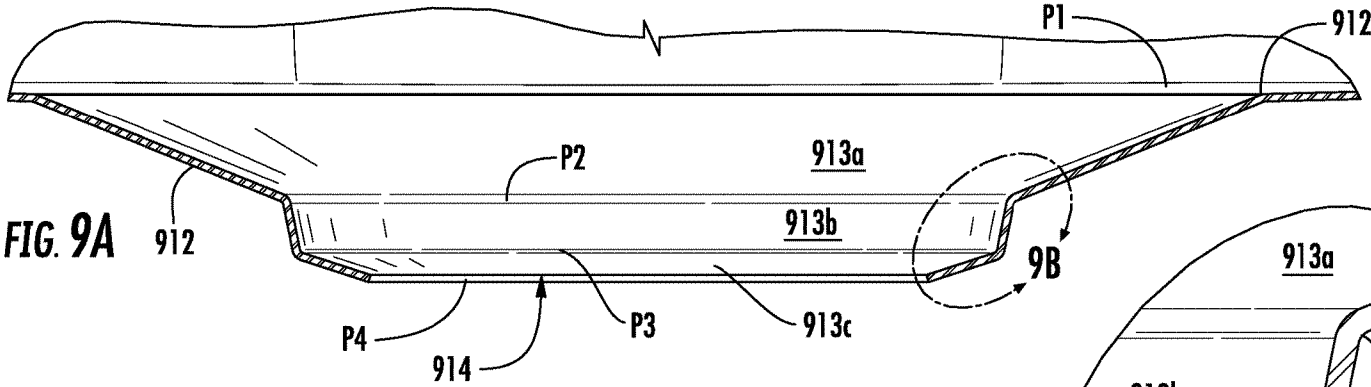
FIG. 9A is a detail view of a portion of the sink of FIG. 9.
Figure 9B:
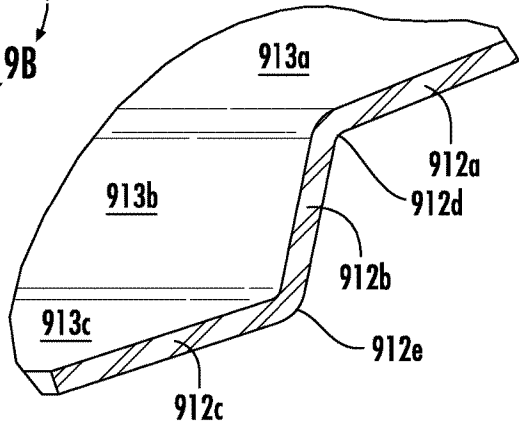
FIG. 9B is a detail view of a portion of the sink of FIG. 9A.

FIGS. 9-9B illustrate an exemplary embodiment of a sink 910 wherein like elements from previous figures have similar designations increased by an order of nine (e.g., sink 110 shown in FIG. 1 is sink 910 in FIG. 9). According to an exemplary embodiment, the sink 910 includes a projection 912 configured having first, second, and third portions 912*a*, 912*b*, 912*c*. As shown in FIG. 9A, the first portion 912*a* is configured having an outer diameter of about 8.0 inches (203.2 mm) and extends from the bottom wall 911*a* at a first angle A1 equal to about 22° (twenty-two degrees) relative to the first plane P1. As shown in FIGS. 9A and 9B, the second portion 912*b* is configured having an outer diameter of about 4.66 inches (118.4 mm) and extends from the bottom wall 911*a* at a second angle A2 equal to about 81° (eighty-one degrees) relative to the second plane P2. As shown in FIG. 9A, the third portion 912*c* is configured having an outer diameter of about 4.54 inches (115.3 mm) and extends from the bottom wall 911*a* at a third angle A3 equal to about 18° (eighteen degrees) relative to the third plane P3. Also shown, the third portion 912*c* includes a drain opening 914 having a diameter of about 3.62 inches (91.95 mm). Thus, the drain opening 914 includes an outer periphery that is defined by the surface having the diameter of about 3.62 inches (91.95 mm). As shown in FIG. 9B, a first radius 912*d* may be provided between the first and second portions 912*a*, 912*b*, and a second radius 912*e* may be provided between the second and third portions 912*b*, 912*c*. Additionally, a third radius 912*f* may be provided between the first portion 912*a* and the bottom wall 911*a*, and/or a fourth radius (not shown) may be provided where the third portion 912*c* transitions to the drain opening 914. It is noted that any one or combination of the radii disclosed may be replaced with another type of transition, such as a chamfer, having any suitable shape.

The cavity 913 between the projection 912 and the first plane P1 of the bottom wall 911*a* may include more than one section. For example, the cavity 913 may include first and second sections 913*a*, 913*b*, which may correspond to the first and second portions 912*a*, 912*b* of the projection 912. The first section 913*a* may have a frusto-conical shape that is bounded by the first portion 912*a*, the first plane P1, and a second plane P2 located at the intersection between the first and second portions 912*b*, 912*c*, as shown in FIG. 9A. The second section 913*b* may have a frusto-conical shape that is bounded by the second portion 912*b*, the second plane P2 located at the intersection between the first and second portions 912*a*, 912*b*, and a third plane P3 located at the intersection between the second and third portions 912*b*, 912*c*, as shown in FIG. 9A.

The cavity 913 may include first, second, and third sections 913*a*, 913*b*, 913*c*, where the first and second sections 913*a*, 913*b* may be configured the same as, similar to, or different than the first and second sections 913*a*, 913*b* discussed above. The third section 913*c* may have a frusto-conical shape that is bounded by the third portion 912*c*, the third plane P3 located at the intersection between the second and third portions 912*b*, 912*c*, and a fourth plane P4 located at the drain opening 914, as shown in FIG. 9A.

As shown in FIGS. 1-2A, the sink 110 may also include a rim 110*d* that is configured to extend around at least a portion of the top of the sink 110. For example, the rim 110*d* may extend partially or completely around a periphery of the top of the basin 111 in an outwardly manner.

As shown in FIGS. 1-6, the drain cover 120 is configured to be installed into the cavity 113 to provide a seamless appearance with the sink 110 (e.g., the projection 112 and bottom wall 111*a* of the basin 111) while allowing for sufficient draining through the drain. In other words, the configuration and/or location of the drain cover 120 (with respect to the sink 110) is configured to harmonize, such that the drain cover 120 blends in with the bottom wall 111*a* in a seamless manner to a person standing over the sink 110. According to an exemplary embodiment, the drain cover 120 includes a base 121 and a leg 122 extending from the base. However, the drain cover 120 may be configured to include a plurality of legs 122. According to another exemplary embodiment (not shown), one or more legs 122 may extend upwardly from the projection 112 and receive the drain cover 120 to removably couple the drain cover 120 to the sink 110.

Figure 10:
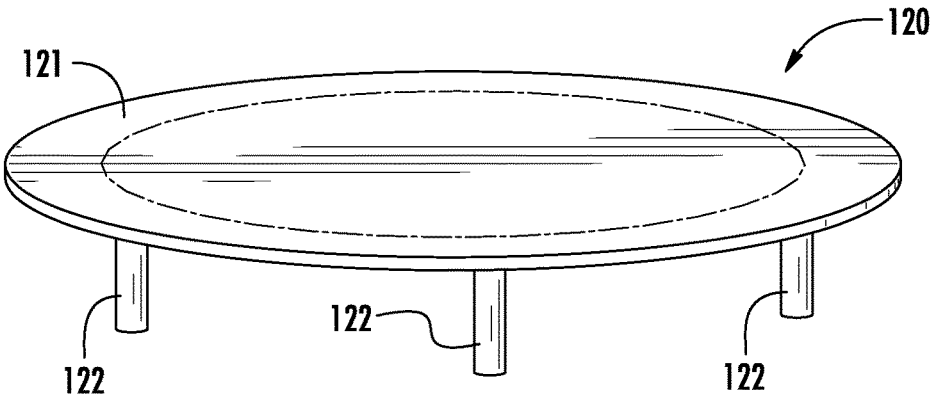
FIG. 10 is a perspective view of an exemplary embodiment of a drain cover.
Figure 11:
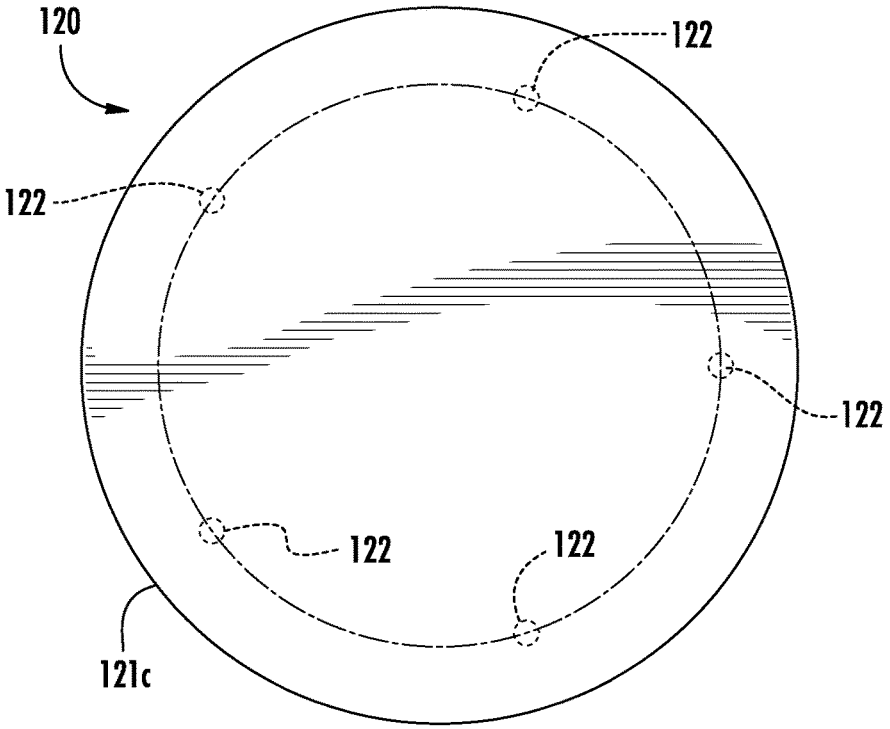
FIG. 11 is a top view of the drain cover of FIG. 10.
Figure 12:
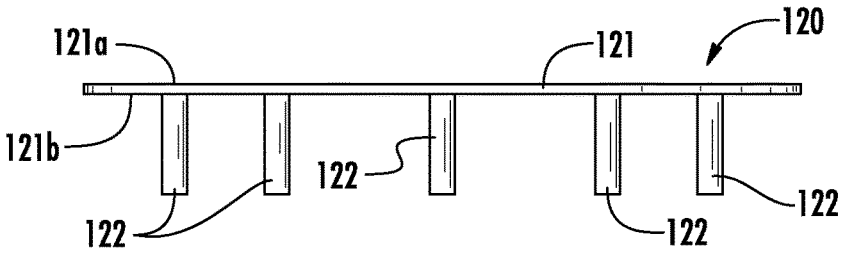
FIG. 12 is a front view of the drain cover of FIG. 10.

FIGS. 10-12 illustrate another exemplary embodiment of the drain cover 120 that includes five legs 122 extending from an underside (e.g., a bottom surface) of the base 121 in a downwardly direction. As shown, the base 121 has a circular shape to harmonize with the conical shape of the projection 112 to provide a seamless appearance of the drain cover 120 with the projection 112 and the bottom wall 111*a* of the basin 111 (for example, see FIGS. 3-6). The circular base 121 has a top surface 121*a* (e.g., a topside, a top, an upper surface, etc.), a bottom surface 121*b* (e.g., an underside, a bottom, a lower surface, etc.) provided on the opposite side relative to the top surface 121*a*, and an outer periphery 121*c* (e.g., perimeter, outer surface, etc.). As shown in FIG. 11, the outer periphery 121*c* is circular with a diameter of about 5.38 inches (136.5 mm). Thus, the outer periphery 121*c* of the drain cover 120 may be configured to be larger in size (e.g., diameter) than the size of the second portion 112*b* of the projection 112 and/or the drain opening 114 (for example, see FIGS. 3-6), such as to obscure them from view of a person standing over the sink 110.

The legs 122 of the drain cover 120 may be arranged in a circular pattern on the bottom surface 121*b*. As shown in FIG. 11, the circular pattern of the five legs 122 has a diameter of about 4.22 inches (107.2 mm) and is concentric (e.g., coaxial) with the circular outer periphery 121*c*. As shown in FIGS. 1-6, this arrangement may advantageously allow the pattern of legs 122 to engage the projection 112, such as the second portion 112*b*, in a concentric manner, while arranging the base 120 (e.g., the outer periphery) concentric with the projection 112, such as the first portion 112*a*, which may help provide the seamless appearance between the drain cover 120 and the sink 110.

Each leg 122 may have any suitable shape. As shown in FIGS. 10-12, each leg 122 has a cylindrical shape, such that each leg 122 is elongated with a circular cross-section. Each leg 122 may have an end that has the same cross-section as the rest of the leg, or the end of the leg may be tapered (not shown). Alternatively, each leg 122 may be tapered the entire length of the leg or any length less than the entire length of the leg (not shown). The angle of the taper of the leg 122 may be configured to match the angle A2 of the second portion 112*b* (see FIG. 3A). For example, the leg 122 may have a taper configured at an angle of 81° (eighty-one degrees). Each leg 122 may extend a length (e.g., distance) that allows the drain cover 120 to engage the projection 112. As shown in FIGS. 3-8, each leg 122 may extend a length that puts the end of each leg into the second portion 112*b* to facilitate removably attaching the drain cover 120 to the sink 110.

The drain cover 120 may be made out of a material that is configured to match the appearance (e.g., color, material, finish, etc.) of the sink 110. For example, the drain cover 120 may be made out of metal, such as stainless steel or cast iron, which is configured to match the appearance of the sink 110, such as by having a brushed appearance. Also, for example, the drain cover 120 may be made out of a plastic (e.g., polymer) material that is configured to match the sink 110, such as an enameled sink. The base 121 may include more than one layer, such as, for example, by being a laminate having at least a substrate layer and at least a finish layer provided over the substrate, where the substrate may be a polymer or other suitable material, and the finish layer may be a metal or other suitable material that is configured to match the appearance of the sink 110. The legs 122 may be integrally formed with the base 121, such as with the substrate layer, or may be formed separately and coupled to the base 121.

It is noted that the drain cover 120 may include any number of legs 122, which may be configured having any suitable size, but it may be advantageous for the drain cover 120 to include at least three legs 122 to provide a better fit condition with the conical shaped projection 112 of the sink 110. Three or more legs 122 may help the drain cover 120 engage the sink/and or the drain more securely, and may help the coupled drain cover 120 fit concentrically with the projection 112 of the sink 110. Additionally, the spacing between the legs 122 is large enough to allow most objects entering the recessed projection 112 to pass through the legs 122 into the drain.

As shown in FIGS. 3-6, when the drain cover 120 is installed into the cavity 113, the legs 122 are configured to extend from the first section 113*a* into the second section 113*b* of the cavity, and the top surface 121*a* of the base is configured substantially coplanar with an upper surface of the bottom wall 111*a*. In other words, the legs 122 of the drain cover 120 may engage a recess in the sink 110 to remotely secure the drain cover 120 in place over the drain opening 114, such that the top surface of the bottom wall 111*a* and the top surface 121*a* are coplanar. This arrangement advantageously allows the user to slide objects in the bottom of the sink 110, such as along the bottom wall 111*a* and the drain cover 120, without the drain cover 120 impeding movement of the object, which would result if the drain cover 120 stood proud of the top surface of the bottom wall 111*a*. Moreover, when the drain cover 120 is installed into the cavity 113, the outer periphery 121*c* of the base 121 extends beyond the outer periphery of the drain opening 114. This arrangement advantageously prevents the drain and/or drain opening 114 from being visible from a perspective above the drain cover 120. The drain cover 120 may be configured to obscure the drain and/or drain opening 114 completely from the vision of a user, such as at all perspectives above and around the sink 110. The outer periphery 121*c* of the drain cover 120 may be configured to leave a gap between the base 121 and the projection 112, such as the first portion 112*a*, in order to allow for objects placed in the bottom of the sink 110 to be washed into the drain through the gap and through the spacing between the legs 122 of the drain cover 120. The size of the gap may be tailored, but according to an exemplary embodiment, a gap of about 1.31 inches (33.3 mm) provides enough clearance to allow most disposed objects (i.e., objects intended to be washed into the drain) to pass through, while providing a harmonious appearance that obscures the drain opening 114 and drain.

Figures 7, 7A:
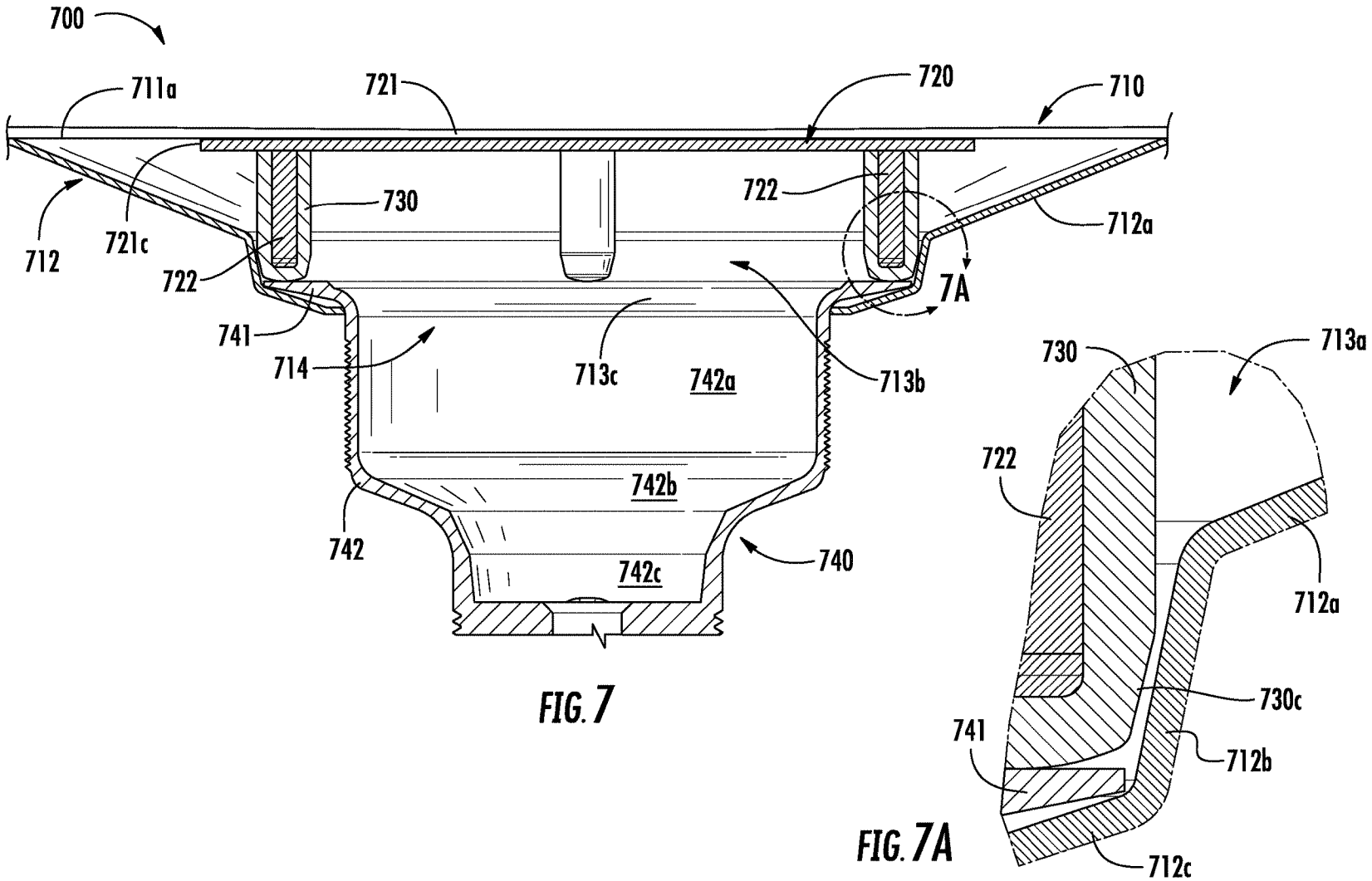
FIG. 7 is a cross-sectional view of a sink assembly including a drain cover coupled to a sink and covering a drain, according to another exemplary embodiment.
FIG. 7A is a detail view of a portion of the cross-sectional view of FIG. 7.

FIGS. 7-7A illustrate another exemplary embodiment of a sink assembly 700 wherein like elements from previous figures have similar designations increased by an order of seven (e.g., sink 110 of FIG. 1 is sink 710 of FIG. 7). The sink assembly 700 includes, a sink 710, a drain 740, and a drain cover 720 engaging a recess in the sink 710 over the drain 740 to obscure the drain opening 714 and drain 740 from view by a person standing over the sink assembly 700. The sink 710 may be configured the same as any sink disclosed herein, or may be configured differently.

Figures 8, 8A:
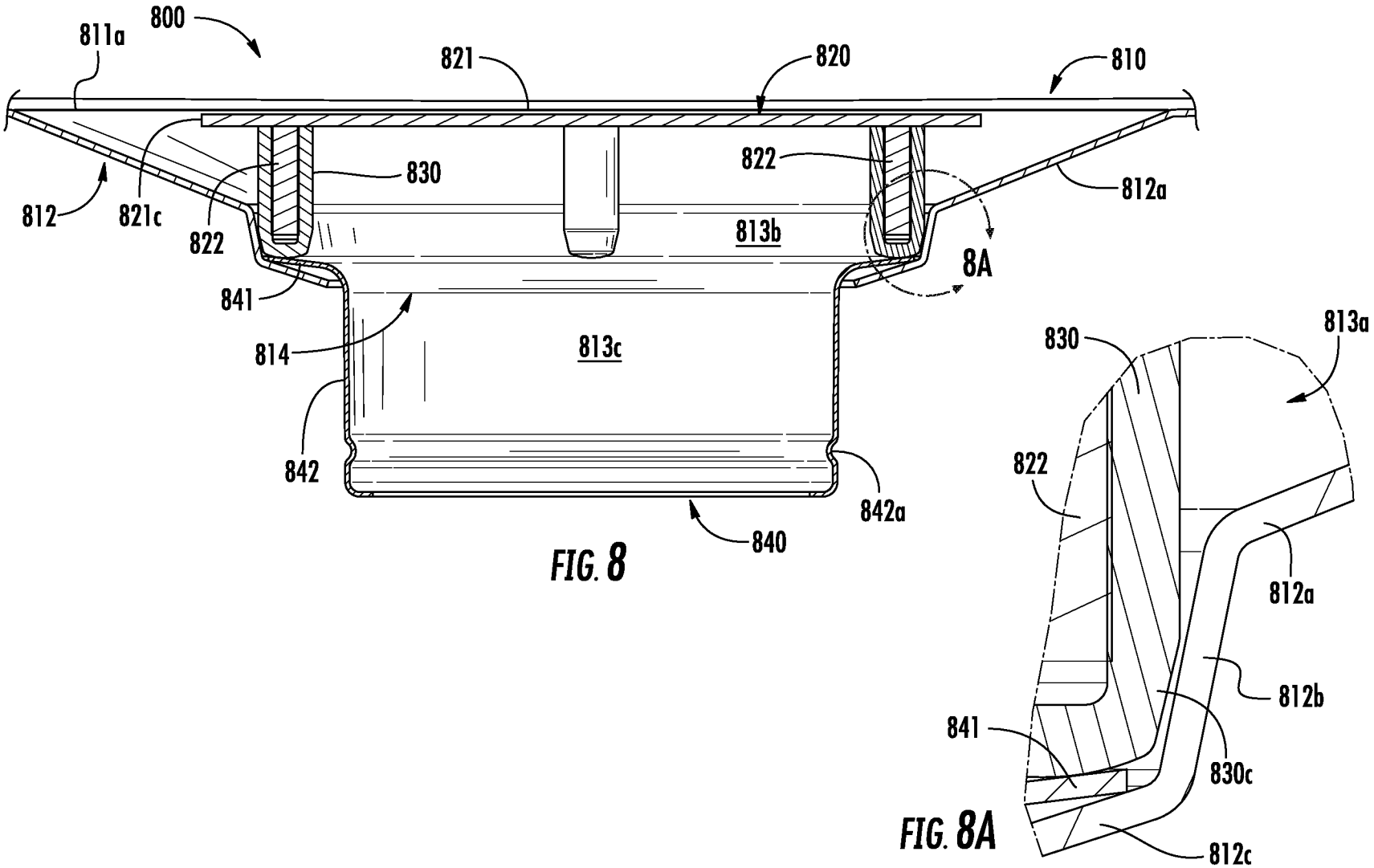
FIG. 8 is a cross-sectional view of a sink assembly including a drain cover coupled to a sink and covering a drain, according to another exemplary embodiment.
FIG. 8A is a detail view of a portion of the cross-sectional view of FIG. 8.

FIGS. 8-8A illustrate yet another exemplary embodiment of a sink assembly 800 wherein like elements from previous figures have similar designations increased by an order of eight (e.g., sink 110 of FIG. 1 is sink 810 of FIG. 8). The sink assembly 800 includes, a sink 810, a drain 840, and a drain cover 820 engaging a recess in the sink 810 over the drain 840 to obscure the drain opening 814 and drain 840 from view by a person standing over the sink assembly 800. The sink 810 may be configured the same as any sink disclosed herein, or may be configured differently.

As shown in FIGS. 7-8A, each sink 710/810 includes a recessed projection 712/812 having first, second, and third portions 712*a*/812*a*, 712*b*/812*b*, 712*c*/812*c*, where the third portion 712*c*/812*c* has a drain opening 714/814 therein. The drain 740/840 is configured to engage the drain opening 714/814 in order to carry away water and objects placed down the drain opening. As shown in FIG. 7, the drain 740 includes a body 742 and a flange 741 extending away (e.g., perpendicularly away) from the body 742, where the body 742 includes a first cylindrical section 742*a*, a tapered section 742*b*, and a second smaller cylindrical section 742*c* provided below the tapered section 742*b*. As shown in FIG. 8, the drain 840 includes a body 842 and a flange 841 extending away from the body, where the body 842 is configured as a cylindrical section including a recess 842*a* (e.g., a channel, an undercut, etc.) that is provided near the bottom of the cylindrical section.

The flanges 741/841 of the drains 740/840 are configured to engage the projection 712/812, such as a recess formed by the projection, to secure the drain 740/840 to the sink 710/810. As shown in FIGS. 7 and 8, each flange 741/841 extends away from the body 742/842 at a location that is near the plane between the second and third sections 713*b*/813*b*, 713*c*/813*c* of the cavity 713/813 (when installed with the sink 710/810) to engage at least one surface (e.g., an inner surface) of the projection 712/812. The flange 741/841 may be configured to engage a surface of the third portion 712*c*/812*c*, the second portion 712*b*/812*b*, a transition (e.g., radius, chamfer, etc.) between the first and second portions 712*a*/812*a*, 712*b*/812*b*, or any combination thereof. For example, an outer periphery of the flange 741/841 may engage a surface of the third portion 712*c*/812*c* and/or a surface of the transition between the second and third portions 712*b*/812*b*, 712*c*/812*c*, such that the flange 741/841 is supported by the third portion 712*c*/812*c*.

The sink 710/810 may further include a seal (not shown) that is configured to prohibit leaking (e.g., of water). For example, the sink 710/810 may include a seal between the flange 741/841 of the drain 740/840 and the projection 712/812 to seal the interface therebetween to prohibit leaking between the flange and the sink.

Figure 13:
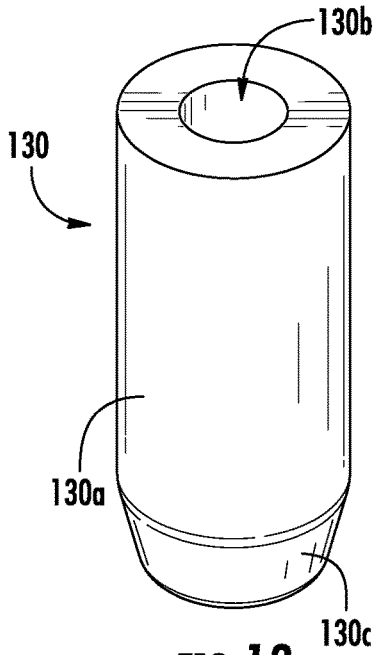
FIG. 13 is a perspective view of an exemplary embodiment of a sleeve for use with a drain cover, such as the drain cover of FIG. 10.
Figure 14:
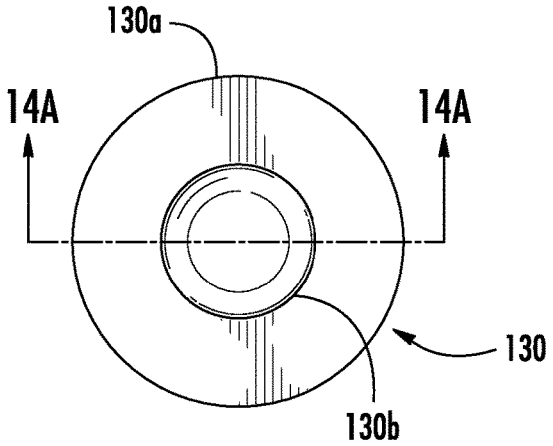
FIG. 14 is a top view of the sleeve of FIG. 13.
Figure 14A:
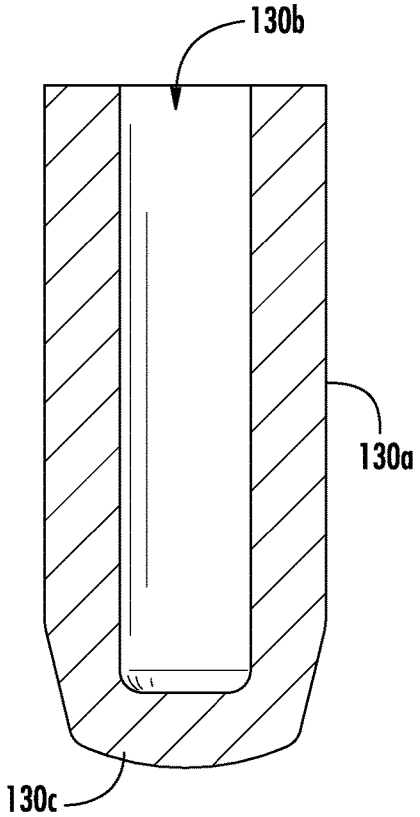
FIG. 14A is a cross-sectional view of the sleeve of FIG. 14.

FIGS. 13-14A illustrate an exemplary embodiment of a sleeve 130 that is configured to be removably disposed over the legs 122 of the drain cover 120. The sleeve 130 may be configured to provide an improved connection between the drain cover 120 and the sink 110. For example, the sleeve 130 may provide a more secure fit condition between the drain cover 120 and the sink 110 when the drain cover 120 is installed. The sleeve 130 may also reduce the likelihood of damage to the sink 110, such as through wear from the drain cover 120 being installed and removed repeatedly. As shown in FIGS. 13-14*a*, the sleeve 130 includes a body 130*a* having a centrally located bore 130*b* extending through a length of the body. The body 130 further includes a tapered end 130*c* located at a distal end of the body.

According to an exemplary embodiment, the sleeve 130 is made from a material that provides an increased friction (e.g., coefficient of friction) between the sink 110 and the sleeve 130 compared to the friction between the sink 110 and the leg 122 of the drain cover 120. For example, the sleeve 130 may be made from a rubber or elastomeric material. The sleeve 130 may be compressible, such as in the event of an interference fit between the sleeve 130 and the sink 110 when the drain cover 120 is installed. For example, the rubber sleeve 130 may compress when the drain cover 120 is installed to provide a more secure connection. The rubber sleeve 130 also prohibits the likelihood of damage to the sink 110 (e.g., the projection 112, bottom wall 111*a*) by contacting the sink 110 directly, as opposed to the legs 122 of the drain cover 120.

The sleeve 130 may be a separately formed part that is configured to slide over the respective leg 122 of the drain cover 120 to removably attach the sleeve to the leg. Alternatively, the sleeve 130 may be over-molded onto the drain cover 120, or integrally formed therewith.

As shown in FIGS. 7A and 8A, the sleeve 730/830 is configured to engage the flange 741/841 of the drain 740/840, such that a gap (e.g., clearance) is provided between the outer surface of the sleeve 730/830 and the second portion 712*b*/812*b* of the projection 712/812. The gap may vary, such as based on manufacturing tolerances, but a nominal gap of 0.011-0.016 inches (0.28-0.41 mm) is shown in the various exemplary embodiments. If the assembly varies to a point where there is an interference fit, the sleeve 730/830 is compressible to allow the drain cover 720/820 to be properly seated or located with the base 721/821 coplanar to the bottom wall 711*a*/811*a*. The sleeve 730/830 may have a tapered end 730*c*/830*c*, such that the angle of taper is configured to match the angle of orientation of the second portion 712*b*/812*b*.

It is noted that although specific dimensions have been provided for various features and elements of the sink assemblies disclosed herein, the dimensions provided are exemplary and are not limiting. In other words, these dimensions may be changed, such as to tailor the features and elements of the sink assemblies to accommodate differently configured sinks, drains, and/or other members.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the sink assemblies as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A sink assembly comprising:

a sink including a basin and a projection provided in a bottom wall of the basin, the projection including a first portion and a second portion that define a cavity and a drain opening, the first portion extending from the bottom wall at a first orientation, the second portion extending from the first portion at a second orientation that is different than the first orientation; and a drain cover installed into the cavity of the projection, the drain cover including a base and at least one leg extending downward from a bottom surface of the base;

wherein a top surface of the base is coplanar with an upper surface of the bottom wall, and an outer periphery of the base extends beyond an outer periphery of the drain opening; and wherein the first portion tapers inwardly and slopes continuously directly from the bottom wall toward a center of the drain opening to define a frusto-conical shape.

2. The sink assembly of claim 1, wherein there is a gap between the outer periphery of the base and the first portion.

3. The sink assembly of claim 2, wherein the outer periphery of the base extends beyond an outer periphery of the second portion.

4. The sink assembly of claim 3, wherein the second portion of the drain opening is conical shaped.

5. The sink assembly of claim 4, wherein the drain opening further includes a third portion extending from the second portion at a third orientation that is different than the second orientation; and wherein the third portion includes an opening that serves as the drain opening.

6. The sink assembly of claim 5, further comprising a drain removably coupled to the drain opening, wherein the drain includes a flange and a body extending therefrom, the flange being in contact with the third portion.

7. The sink assembly of claim 6, further comprising a sleeve provided around the at least one leg of the drain cover.

8. The sink assembly of claim 7, wherein the sleeve has a distal end that is tapered at an angle that is complementary to a profile of the second portion.

9. A sink comprising:

a basin having a bottom wall;

a projection provided in the bottom wall; and a drain having a flange and a body extending downward therefrom, the drain being removably coupled to the basin;

wherein the projection includes a first portion and a second portion that define a cavity and a drain opening, the first portion extending from the bottom wall at a first angle and having a surface that tapers inwardly and slopes continuously directly from the bottom wall toward a center of the drain opening to define a frusto-conical shape, the second portion extending from the first portion at a second angle that is different than the first angle.

10. The sink of claim 9, wherein the second portion of the drain opening is conical shaped.

11. The sink of claim 10, wherein the drain opening further includes a third portion extending downward from the second portion at a third angle that is different than the second angle; and wherein the third portion includes an opening that serves as the drain opening.

12. The sink of claim 11, wherein the drain is removably coupled to the third portion such that the flange engages a surface of the third portion and the body extends through the drain opening.

* * * * *